US008026658B2

(12) United States Patent
Favreau et al.

(10) Patent No.: US 8,026,658 B2
(45) Date of Patent: Sep. 27, 2011

(54) FLEXIBLE SCREEN COMPRISING CATHODIC MICROTUBES

(75) Inventors: Jean-Chrétien Favreau, Paris (FR); Jean-François Peyre, Rousset (FR); Matthieu Mauger, Cannes la Brocca (FR)

(73) Assignee: Newstep, Paris (FR)

( * ) Notice: Subject to any disclaimer, the term of this patent is extended or adjusted under 35 U.S.C. 154(b) by 1012 days.

(21) Appl. No.: 11/791,254

(22) PCT Filed: Apr. 14, 2004

(86) PCT No.: PCT/FR2004/000911

§ 371 (c)(1),
(2), (4) Date: May 21, 2007

(87) PCT Pub. No.: WO2004/095492

PCT Pub. Date: Nov. 4, 2004

(65) Prior Publication Data

US 2009/0051261 A1 Feb. 26, 2009

(30) Foreign Application Priority Data

Apr. 19, 2003 (FR) ..... 03 04897

(51) Int. Cl.
*H01J 63/04* (2006.01)

(52) U.S. Cl. ..... 313/495; 313/2.1

(58) Field of Classification Search ..... 313/495–497, 313/1–6, 310; 438/20; 348/778, 779; 345/1.3
See application file for complete search history.

(56) References Cited

U.S. PATENT DOCUMENTS

| | | | | |
|---|---|---|---|---|
| 4,571,523 | A * | 2/1986 | Morimoto et al. | 313/497 |
| 5,311,337 | A * | 5/1994 | McCartney, Jr. | 349/145 |
| 5,504,387 | A * | 4/1996 | Hamagishi et al. | 313/310 |
| 5,633,561 | A * | 5/1997 | Barker | 313/497 |
| 5,789,856 | A * | 8/1998 | Itoh et al. | 313/495 |
| 6,072,274 | A | 6/2000 | Jondrow | |
| 6,608,438 | B2 * | 8/2003 | Topelberg et al. | 313/511 |
| 6,764,367 | B2 * | 7/2004 | Green et al. | 445/24 |
| 2001/0034174 | A1 * | 10/2001 | Moore | 445/24 |
| 2003/0026171 | A1 * | 2/2003 | Brewer et al. | 368/82 |

FOREIGN PATENT DOCUMENTS

| | | |
|---|---|---|
| EP | 0 854 493 B1 | 3/2003 |
| FR | 2 779 859 A1 | 4/1999 |

* cited by examiner

*Primary Examiner* — Nimeshkumar Patel
*Assistant Examiner* — Steven Horikoshi
(74) *Attorney, Agent, or Firm* — Miles & Stockbridge P.C.

(57) ABSTRACT

A display screen, characterized in that the pixels of the image are generated by individual light-emitting capsules, said capsules constituting miniature cathodic tubes cold-cathode and being assembled in a matrix on a least one substrate of supple support, optionally transparent. The material emitting electrons of the capsules may be constituted by carbon nanotubes. The assembly of the capsules may be realized by forced insertion of the prefabricated capsules into a supple support, with or without previously cutting out placements of the capsules in the supports. Assembly of the capsules may likewise be done by moulding the prefabricated capsules in a supple support.

Advantageously, the size of the capsules is optimized to ensure optimum matricial assembly of the pixels or correct balance of the non-printing areas, with for example a larger size for the capsules emitting its green light.

6 Claims, 3 Drawing Sheets

FLEXIBLE SCREEN COMPRISING CATHODIC MICROTUBES

CROSS REFERENCE TO RELATED APPLICATIONS

This application claims the benefit of PCT Application Serial No. PCT/FR2004/00911, filed Apr. 14, 2004, now pending, which claims the benefit of and priority to French Patent Application No. FR0304897, filed Apr. 19, 2003, all of which are incorporated herein by reference in their entirety.

The subject of the present invention is a flexible display device whereof each image point is constituted by one or more cold-cathodoluminescence capsules, these capsules being sealed individually and assembled by an automated process on a supple substrate.

FIELD OF THE INVENTION

The present invention relates to the domain of flat display screens comprising large-size screens, typically over a metre in diagonal.

Conventionally, such screens comprise an assembly of image elements or pixels, organised in a matrix and addressed by a network of conductors in rows and by a network of conductors in columns.

SUMMARY OF THE INVENTION

According to the object of the present invention, these display elements are capsules constituting miniature cold-cathode cathodic tubes, having for example one capsule for each colour point of each pixel.

In addition, these capsules are designed to be able to be assembled automatically and form a flexible screen on a supple substrate, without requiring a complex transfer operation.

The present invention thus describes a display screen, characterised in that the pixels of the image are generated by individual light-emitting capsules, said capsules constituting miniature cathodic tubes cold-cathode and being assembled in a matrix on at least one substrate of supple support, optionally transparent.

According to a preferred embodiment the material emitting electrons of the capsules is constituted by carbon nanotubes.

The assembly of the capsules is preferably realised by forced insertion of the prefabricated capsules into a supple support, with or without previously cutting out placements of the capsules in the supports.

Assembly of the capsules is preferably likewise done by moulding the prefabricated capsules in a supple support.

Advantageously, the size of the capsules is optimised to ensure optimum matricial assembly of the pixels or correct balance of the non-printing areas, with for example a larger size for the capsules emitting its green light.

According to a preferred embodiment of the present invention, a tactile detection device, of mechanical, optical, resistive, capacitive or other type, is put in place at least on one part of the screen, as a complement to the luminous capsules.

According to one of the embodiments of the present invention, the capsules are connected and fed by conductive films made from the film media.

For example, the capsules are connected and fed by at least two conductive films on the films media, one of the films located substantially at the front side of the screen, on the user side, the other film located substantially on the rear side, opposite the user, the capsules automatically connecting to each film during their assembly.

According to another embodiment of the present invention, the capsules are connected and fed by one or more networks of supple metallic hollow wires, optionally organised so that one of the networks connects the tubes in rows perpendicular to the connection rows made by the other network, the connections permitting relative movement of the capsules among one another necessary during flexion of the screen.

By way of advantage, at least part of the capsules is equipped with a colour filter, made by tinting the glass of the capsule or by attached a colour film, said filter being optimised for preferentially transmitting the light spectrum of colour close to the light emitted by the capsule on which it is mounted.

To facilitate assembly, the capsules of each primary colour of each image element can be assembled as a trio prior to being mounted on the substrate support.

The invention will be better understood, and other aims, advantages and characteristics thereof will emerge more clearly from the following description of preferred embodiments given by way of non-limiting example and accompanied by a set of diagrams, in which:

DETAILED DESCRIPTION

Figure 1:
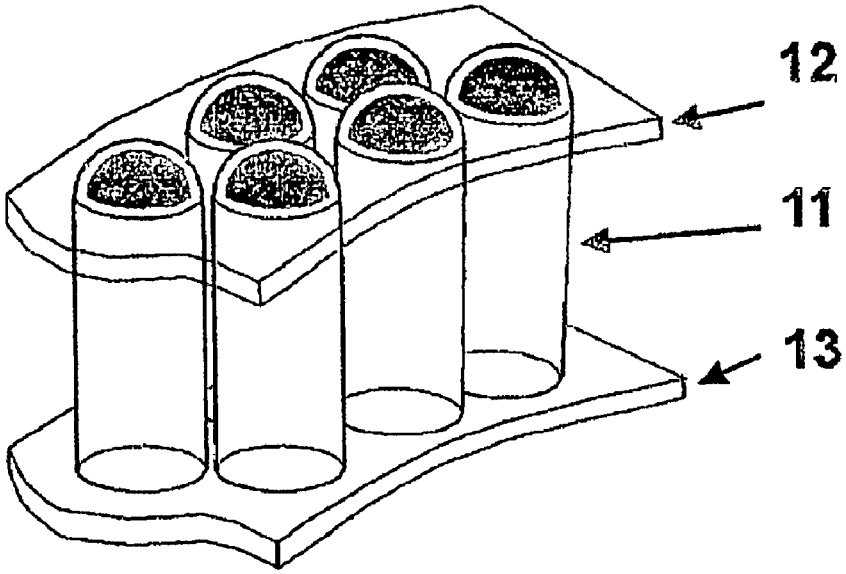
FIGS. 1 to 5 are schematic representations of certain embodiments according to the present invention.

FIG. 1 schematically illustrates the assembly of cathodoluminescent capsules 11 on a supple substrate represented here by two flexible films 12, 13 supporting the conductive films for addressing and feeding, not shown in this figure. It is understood that it would be an advantage to use only a single flexible film of adequate thickness, carrying a network of conductors on each of its faces.

Figure 2:
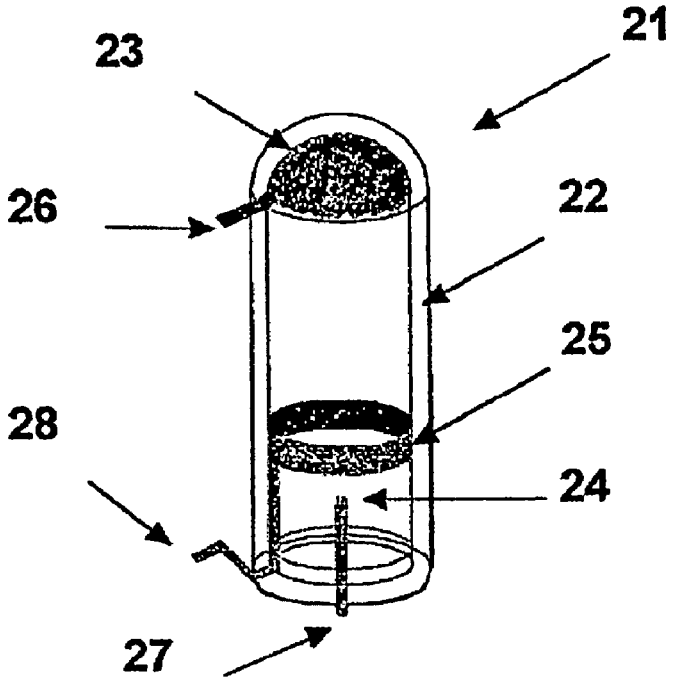

FIG. 2 proposes a schematic section of an individual capsule 21, so as to specify the function and the connection mode:

A sealed glass envelope 22 empty of air contains a cold cathode 24 emitting electrons by field effect with respect to luminophorous powder 23, a material emitting light when it receives electrons of adequate energy. A control grid 25, here in annular shape, helps control the emission of electrons by regulating the potential and thus the electric field in the vicinity of the cathode 24. Such a capsule thus comprises three electrodes 26, 27 and 28 respectively connecting the luminophores 23, the cathode 24 and the control grid 28. According to the present invention, these three electrodes shall be connected automatically, during assembly of the capsules, to the corresponding conductor networks. For example, the anode contacts 26 of all the tubes could advantageously all be connected in parallel to a common conductor plan providing high-voltage continuous feed, while the electrodes 27 and 28 shall be traditionally connected in networks in rows and columns.

In the case according to the invention described in the application FR 02 13 287 in which each capsule is piloted locally by an addressing microcircuit, all the corresponding electrodes of the capsules could be connected in parallel.

In addition, and according to the invention described in the application FR 02 13 285, incorporating a microtransformer into or on each capsule creates locally the anode voltage, which then also becomes the control voltage. Each capsule then has only two external electrodes, those of the primary circuit of the microtransformer, to be connected either in network in rows and columns, or in parallel by means of addressing microcircuits individual to each capsule.

Figure 3:
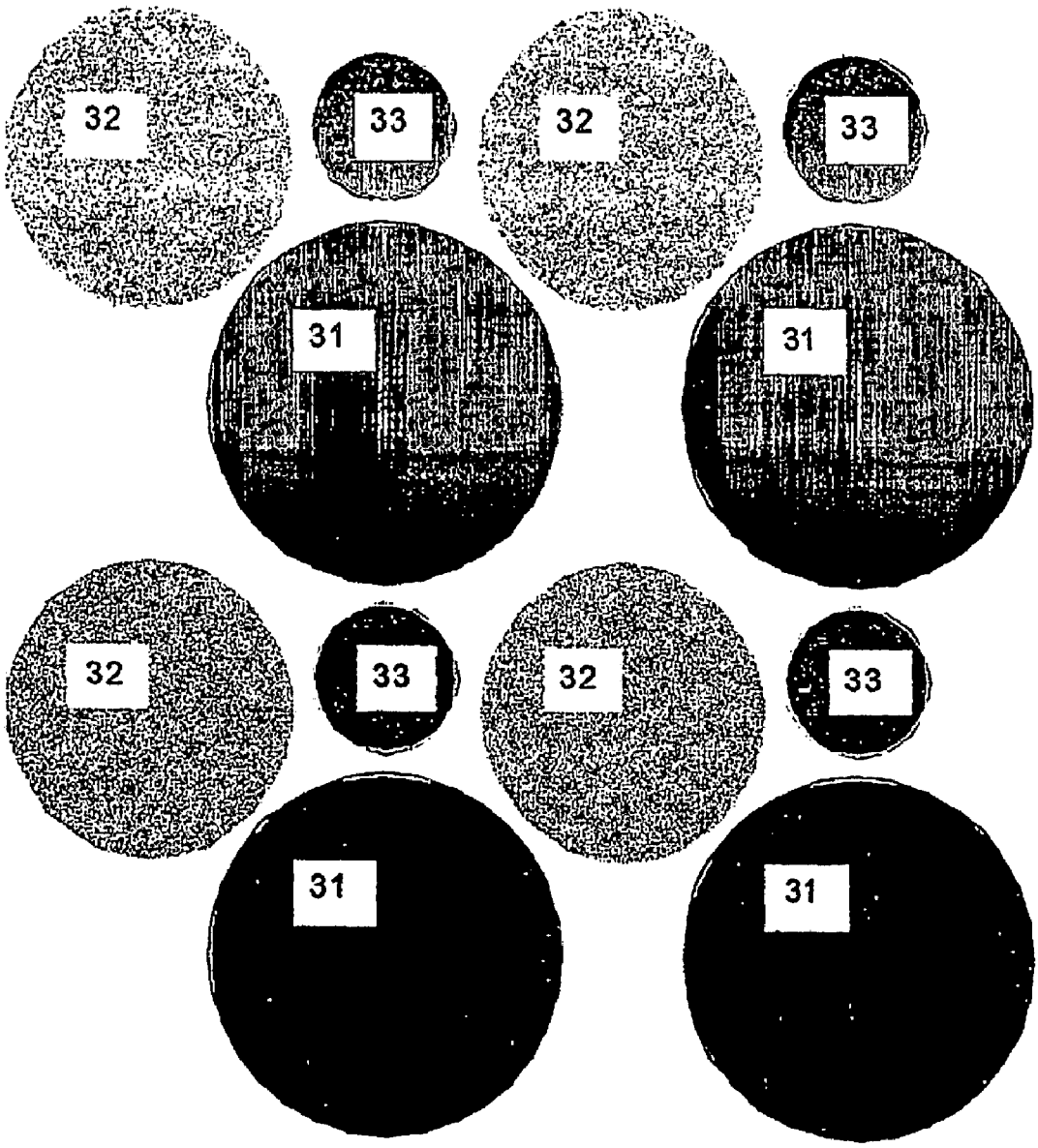

FIG. 3 is a view from the user side of a screen according to an embodiment of the present invention wherein capsules of different diameters 31, 32 and 33 are utilised for each colour. Such an arrangement can:

- optimise the relative intensity of each colour and thus provide a correct blank area,
- better compose the capsules and thus obtain a large emitting surface, while conserving a square form preferable for pixels of the screen.

Figure 4:
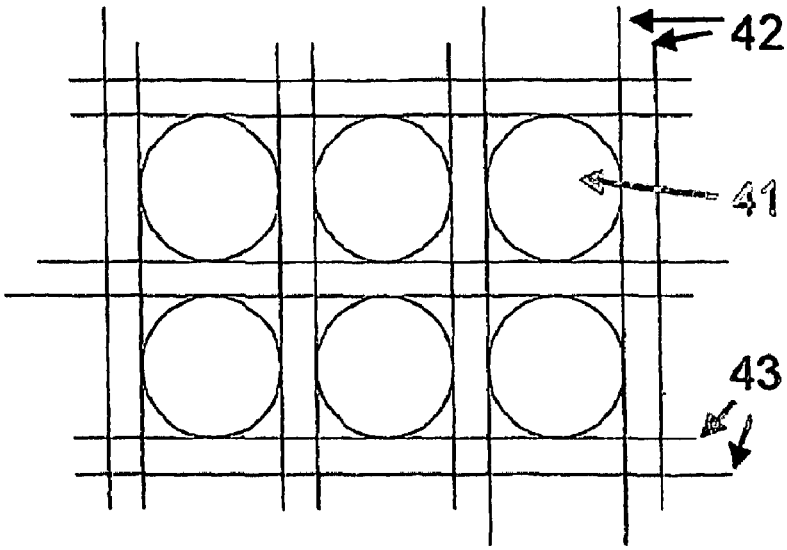

FIG. 4 is a view from the user side of a screen according to an embodiment of the present invention wherein the capsules 41 are connected by means of a network of supple metallic wires 42 arranged in a mesh, completed by a network of perpendicular wires 43, capable of being conductive, if all the electrodes are connected in parallel, or insulating if the aim is to connect the electrodes in one direction only, in rows or in columns.

Figure 5:
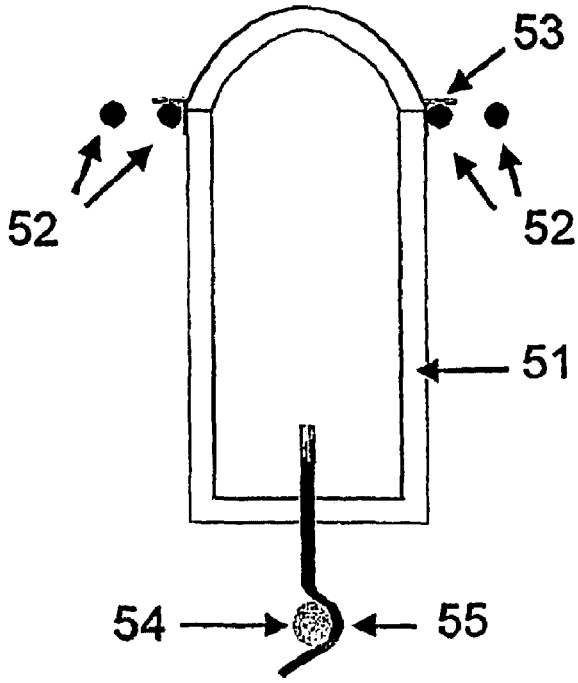

FIG. 5 is a sectional view specifying the possible construction of a capsule in such an embodiment:

- the anode contact of the capsule 51 is equipped with a metallic flange 53, connected by the mesh wires 52, corresponding to the wires 42 of FIG. 4.
- the cathode is connected by an electrode in the form of a hook 55 to a second network of conductor wires 54, which could obviously be perpendicular to the conductors 52, if needed. The role of the hook is to lock the capsule in place, using the spring effect resulting from the mechanical tension applied to the wires 52 and 54, enabling mechanical sliding of the contact during flexion of the screen.

For each embodiment, it is preferable to include a protective transparent film covering the user side of the capsules and sealing the assembly against storms. Similarly, an encapsulation film, which does not need to be transparent, will be provided in the rear face.

According to the invention, making a flexible display screen by automated assembly of individual cathodoluminescent capsules on a supple substrate contributes a large number of advantages whereof an example is described hereafter:

- the result is a flexible but reliable screen, from using miniature rigid and sealed capsules, without having to make supple light-emitting devices. In fact, the development of such supple devices, including organic electroluminescent diodes, encounters difficulties in compatibility of the organic materials, as well as contamination and degradation, especially by diffusion of atmospheric gases in the emitting layers.
- this gives a large-size supple screen at low cost, by optimising the capsules and their assembly and connection system so as to eliminate any necessarily costly individual positioning and transfer system.

To avoid having to sort the capsules of different colours, the capsules could be grouped as a trio prior to assembly, forming a complete pixel capable of taking a polarised form facilitating its insertion in the right direction.

According to the assembly mode used, a reparable screen could be produced, for example to guard against vandalism.

The individual cathodoluminescent capsules effectively all utilise the electrons emitted, without loss of electrons in the metallic mask or the inter-pixel space as in a cathodic screen or a classic field emission screen. The result is considerable luminous efficacy.

It is possible to produce coloured filters by tinting the glass of each capsule or by bringing in a colour film, much more easily than for a conventional cathodic tube. Such coloured filters substantially improve the contrast of the screen when illuminated.

The positioning of the various structural elements lends maximum useful effects to the object of the invention, to date not obtained by similar devices.

We claim:

1. A flexible display screen for displaying a plurality of pixels of an image, said display screen comprising:

- a flexible support member adapted to hold at least one display element associated with each said pixel; and
- feeding means for feeding each said display element,
- wherein each said display element comprises a capsule, each said capsule forming a miniature cold cathode ray tube including a sealed envelope devoid of air, an electron-emitting material positioned in an interior portion of said envelope, and a light emitting material positioned in the interior portion of said envelope and configured to emit light in response to reception of electrons,
- wherein a plurality of said capsules are constructed to be arranged in a matrix upon insertion into the flexible support member, and
- wherein said feeding means includes at least one network of flexible woven metallic wires, said network having connections with the capsules, said connections being constructed to permit movement of the capsules relative to one another during flexing of the display screen, wherein said connections comprise a hook.

2. The flexible display screen as recited in claim 1, wherein said electron-emitting material is constituted by carbon nanotubes.

3. The flexible display screen as recited in claim 1, wherein said flexible support is transparent.

4. The flexible display screen as recited in claim 1, further comprising:

- a set of three capsules associated with each said pixel, each said capsule being provided with a respective color filter.

5. The flexible display screen as recited in claim 4, wherein said three capsules associated with each said pixel are assembled as a trio prior to being mounted on said support member.

6. The flexible display screen as recited in claim 1, further comprising:

- a tactile detection device positioned on at least one part of the display screen and complementing said plurality of capsules.

* * * * *